United States Patent [19]

Zadera

[11] 4,415,015

[45] Nov. 15, 1983

[54] PROCESS OF COMPACTING MOULDING SAND

[75] Inventor: Lumir Zadera, Flurlingen, Switzerland

[73] Assignee: George Fischer, Ltd., Switzerland

[21] Appl. No.: 207,959

[22] PCT Filed: Jan. 24, 1980

[86] PCT No.: PCT/CH80/00008

§ 371 Date: Oct. 2, 1980

§ 102(e) Date: Oct. 1, 1980

[87] PCT Pub. No.: WO80/01544

PCT Pub. Date: Aug. 7, 1980

[30] Foreign Application Priority Data

Feb. 2, 1979 [CH] Switzerland ..... 1037/79

[51] Int. Cl.[3] ..... B22C 15/00

[52] U.S. Cl. ..... 164/37; 164/169

[58] Field of Search ..... 164/37, 193

[56] References Cited

U.S. PATENT DOCUMENTS 3,170,202 2/1965 Huston, Sr. et al. ..... 164/37
3,807,483 4/1974 Buhler .
4,306,609 12/1981 Fisher et al. ..... 164/37

FOREIGN PATENT DOCUMENTS 728015 4/1955 United Kingdom ..... 164/193

*Primary Examiner*—Kuang Y. Lin
*Attorney, Agent, or Firm*—Roylance, Abrams, Berdo & Farley

[57] ABSTRACT

A process for compacting moulding sand to form a casting mould comprises the steps of filling a moulding space located between a pattern plate and a pressure plate with moulding sand, pre-compacting the moulding sand, after the moulding space is filled with moulding sand and closed by the pressure plate, by an explosive-type shock pressure, and subsequently re-compacting the moulding sand by mechanically pressing the moulding sand between the pattern plate and the pressure plate.

5 Claims, 3 Drawing Figures

PROCESS OF COMPACTING MOULDING SAND

The invention relates to a process for compacting moulding sand to form a casting mould whereby a moulding space between a pattern plate and pressure plate is filled with moulding sand, and thereafter the sand is pre-compacted and mechanically re-compacted.

BACKGROUND OF THE INVENTION

DE-AS 24 03 199 discloses a process wherein moulding sand is placed into a moulding box from a sand container by being shot through shooting apertures while compressed air is fed in such that the sand is pre-compacted. The re-compacting of the pre-compacted moulding sand in the moulding box is effected by a mutual approach of the pattern plate and the pressure plate.

Such process is disadvantageous since the patterns are subjected to a relatively great amount of wear due to the abrasive effect of the moulding sand particles accelerated by shooting them in. Moreover a substantial energy requirement is necessary for shooting-in the sand and this has an unfavourable effect on the cost structure of the mould production.

The attainment of a uniformly high degree of mould hardness, especially in the region of the mould near the pattern, is desirable not only in connection with a mould produced by shooting-in of the moulding sand, but also completely independently of the method of inserting sand into the moulding box. The requisite mold hardness is achieved with mechanical insertion of sand for example by shaking with subsequent mechanical pressing.

Since shaking is increasingly unpopular because of the noise and the vibrations associated therewith, there is a need to produce a uniformly good casting mould with technically satisfactory mould hardness by means of other, environmentally more pleasing and more productive methods.

BRIEF DESCRIPTION OF THE INVENTION

Accordingly, an object of the present invention is to provide a process for compacting of moulding sand to form a casting mould, wherein the moulding sand is first pre-compacted and then subsequently re- or finally-compacted, such that patterns on a pattern plate are exposed to the least possible wear and the energy costs necessary for compacting are minimized.

Other objects, advantages and salient features of the present invention will become apparent from the following detailed description of a preferred embodiment of the invention.

Briefly described, the invention includes an improved process for compacting moulding sand to form a casting mould, comprising the steps of filling a moulding space located between a pattern plate and a pressure plate with moulding sand, pre-compacting the moulding sand, after the moulding space is filled with moulding sand and closed by the pressure plate, by an explosive-type shock pressure, and subsequently re-compacting the moulding sand by mechanically pressing the moulding sand between the pattern plate and the pressure plate.

By compacting the moulding sand in this manner a casting mold is formed uniformly with the requisite high degree of hardness. Wear on the patterns is minimized by eliminating the high speed insertion of the sand. Additionally, the energy requirements of the system are minimized to lower production costs.

BRIEF DESCRIPTION OF THE DRAWINGS

In order that the manner in which the foregoing and other objects are attained in accordance with the invention can be understood in detail, a particularly advantageous embodiment will be described with reference to the accompanying drawings, which form a part of this specification, and wherein.

DETAILED DESCRIPTION OF THE PREFERRED EMBODIMENT OF THE INVENTION

Figure 1:
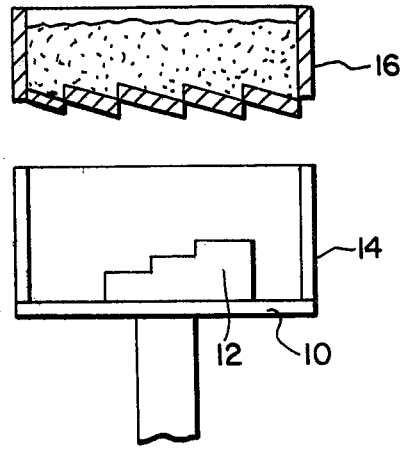
FIG. 1 is a schematic, side elevational view of a system for compacting moulding sand according to the present invention prior to filling of the moulding space.
Figure 2:
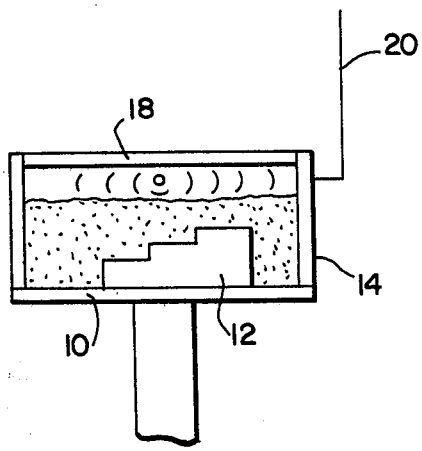
FIG. 2 is a schematic, side elevational view of the system of FIG. 1 during the pre-compacting step.
Figure 3:
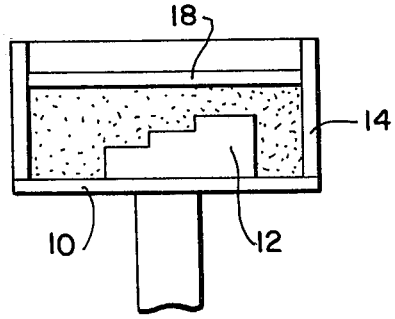
FIG. 3 is a schematic, side elevational view of the system of FIG. 1 during the re-compacting step.

According to the present invention, patterns are extremely carefully reproduced in casting moulds with the moulding material (i.e., sand) being introduced into the moulding space or moulding box and about the patterns only under the force of gravity. A highly-pressurized gaseous medium, for example, compressed air, is used to produce the explosive shock pressure such that energy costs will be lower than with a sand shooting process. The process will be even more economical whenever fuel is made to explode. With the explosion process, which is known per se for example from U.S. Pat. No. 3 170 202, reproducibility cannot be exactly controlled, so that there is a high quota of errors. Thus, according to the invention the explosion process is used merely for pre-compacting the sand to largely eliminate the amount of errors.

Referring to the drawings wherein the system of the present invention is schematically illustrated, the process involves introducing moulding sand into a conventional moulding box, comprising a pattern 12 and disposed on a pattern plate 10, from a conventional filling frame 16 associated therewith. A measured or dosed amount of a moulding sand falls into the moulding space, defined by the molding frame 14 of the moulding box, from the filling frame 16 under only the force of gravity. Thereafter, a conventional cover or pressure plate 18 closes the molding box after being filled with moulding sand. An explosive-type shock pressure is subsequently exerted on the sand surface in the moulding space formed between the moulding sand surface and the cover to pre-compact the moulding sand. After the pre-compacting step, the sand is subsequently and finally re-compacted mechanically between the pressure plate and the pattern plate.

To produce the shock pressure, advantageously a fuel is supplied via line 20 and is combusted by detonation or explosion to produce the shock pressure on the sand. Alternatively, it is easily possible to produce a shock pressure with an expanding, highly pressurized vaporous or gaseous medium supplied through line 20.

While a certain advantageous embodiment has been chosen to illustrate the invention, it will be understood by those skilled in the art that various changes and modifications can be made therein without departing from the scope of the invention as defined in the appended claims.

I claim:

1. A process for compacting moulding sand to form a casting mould, comprising the steps of:

filling a moulding space located between a pattern plate and a pressure plate with moulding sand;

pre-compacting the moulding sand, after the moulding space is filled with moulding sand and closed by the pressure plate, by an explosive-type shock pressure; and subsequently re-compacting the moulding sand by mechanically pressing the moulding sand between the pattern plate and the pressure plate.

2. A process according to claim 1 wherein said shock pressure is produced by combustion fuel by detonation or explosion.

3. A process according to claim 1 wherein said shock pressure is produced by expanding a highly pressurized vapor.

4. A process according to claim 1 wherein said shock pressure is produced by expanding a highly pressurized gas.

5. A process according to claim 1 wherein the moulding space is filled with a dosed amount of moulding sand only under the force of gravity.

* * * * *